US010829339B2

(12) United States Patent
Lee et al.

(10) Patent No.: US 10,829,339 B2
(45) Date of Patent: Nov. 10, 2020

(54) FRICTION SHAFT FOR SLITTER

(71) Applicant: YUL RIM AIR SHAFT CO., LTD., Incheon (KR)

(72) Inventors: Jae sik Lee, Gyeonggi-do (KR); Soo hyung Lee, Gyeonggi-do (KR)

(73) Assignee: YUL RIM AIR SHAFT CO., LTD., Incheon (KR)

( * ) Notice: Subject to any disclaimer, the term of this patent is extended or adjusted under 35 U.S.C. 154(b) by 71 days.

(21) Appl. No.: 16/355,196

(22) Filed: Mar. 15, 2019

(65) Prior Publication Data

US 2019/0292004 A1 Sep. 26, 2019

(30) Foreign Application Priority Data

Mar. 20, 2018 (KR) ..... 10-2018-0032057

(51) Int. Cl.
*B65H 75/24* (2006.01)
*B65H 18/04* (2006.01)

(52) U.S. Cl.
CPC ..... *B65H 75/248* (2013.01); *B65H 18/04* (2013.01); *B65H 2301/4136* (2013.01); *B65H 2402/514* (2013.01); *B65H 2402/544* (2013.01)

(58) Field of Classification Search
CPC ..... B65H 75/248; B65H 18/04; B65H 2301/4136; B65H 2402/541; B65H 2402/544
See application file for complete search history.

(56) References Cited

U.S. PATENT DOCUMENTS

RE28,911 E * 7/1976 Jespersen ..... B65H 35/002 225/96
4,468,068 A * 8/1984 Kokubo ..... B65H 29/40 312/333
5,240,198 A * 8/1993 Dorfel ..... B65H 18/20 242/542.4

FOREIGN PATENT DOCUMENTS

KR 10-2014-0083406 7/2014

* cited by examiner

*Primary Examiner* — Michael E Gallion
(74) *Attorney, Agent, or Firm* — IP & T Group LLP

(57) ABSTRACT

A friction shaft for a slitter has winding tubes disposed on an outer surface thereof to roll unit materials formed by cutting a raw material such as various kinds of paper, fabric, or film with predetermined intervals. The friction shaft includes a first rotary shaft, tubes, lug bodies for torque, first fixed shafts, brake pads, a second rotary shaft, guide members, lug bodies for clamping, second fixed shafts, a plurality of lug rollers, covers, a first elastic member, and second elastic members.

17 Claims, 20 Drawing Sheets

FRICTION SHAFT FOR SLITTER

CROSS REFERENCE TO RELATED APPLICATION

The present application claims priority to Korean Patent Application No. 10-2018-0032057, filed Mar. 20, 2018, the entire contents of which is incorporated herein for all purposes by this reference.

BACKGROUND OF THE INVENTION

Field of the Invention

The present invention relates to a friction shaft for a slitter and, more particularly, to a friction shaft for a slitter, the friction shaft controlling winding tension of a winding tube using compressed air to enable correspondence to the thickness and weight of a unit material formed by a slitter so that the unit material can be stably wound on the winding tube.

Description of the Related Art

In general, a slitter is an apparatus that cuts raw materials such as various kinds of paper, fabric, or film with predetermined intervals. Winding tubes such as a paper tube are used to roll several unit materials formed by a slitter.

Accordingly, a friction shaft for a slitter which rotates a paper tube using compressed air was used to roll several unit materials such as various kinds of paper, fabric, or film.

However, according to friction shafts for a slitter in the related art, a friction core was inserted/disposed in a main shaft having a small outer diameter, so there was a possibility that main shaft sags and shakes much in winding.

That is, displacement of the main shaft may increase in winding, so there were limits in high-load and high-speed work.

Further, the lengths of friction cores were limited by structures and the range of available torque was also limited, so it was difficult to wind unit materials formed with regular intervals around winding tubes.

That is, it was required to separately prepare or manufacture friction shafts for a slitter which provide winding tension of winding tubes to be suitable for the thickness and weight of unit materials.

In relation to this matter, there has been provided in Patent Document 1 a friction shaft for a slitter which includes: a rod-shaped winding shaft that is rotated by a winding motor; a first hole that is bored in the winding shaft in the longitudinal direction of the winding shaft; a plurality of third holes that is bored from the outer circumferential surface of the winding shaft to the first hole and arranged with predetermined intervals in the extension direction of the first hole; a plurality of holders that are fitted in a paper tube for winding a unit material, are short tubes sequentially fitted on the outer circumference of the winding shaft, and are disposed at the positions of the third holes; and a first pneumatic pressure generator that supplies compressed air to the first hole to press the paper tube with the holders, in which the holders are short tubes and have a plurality of lug seats, and include: a holder base having a connection hole bored to connect the third holes and the lug seats; lugs fitted in the lug seats to be movable in the radial direction of the winding shaft; a spring having an end supported by the lugs and the other end supported by the lug seats to provide force that elastically pushes the lugs in the radial direction of the winding shaft; a fixing cover fixed to the holder base and pressing the outer edges of the lugs to keep the lugs in the lug seats; and a pneumatic guide guiding the compressed air supplied to the first hole to the center of the winding shaft.

That is, as described above, even in Patent Document 1, the size or strength of the spring is limited due to the structure, so if a unit material is thick and heavy exceeding the elasticity of the spring, the unit material is difficult to be wound well on the winding tube.

In other words, according to Patent Document 1, it was difficult to control winding tension of the lugs only using the elasticity of the spring.

DOCUMENTS OF RELATED ART (Patent Document 1) Korean Patent Application Publication No. 10-2014-0083406 (published on Jul. 4, 2014)

SUMMARY OF THE INVENTION

Accordingly, an object of the present invention is to provide a friction shaft for a slitter, the friction shaft controlling winding tension of a winding tube using compressed air to enable correspondence to the thickness and weight of a unit material formed by a slitter so that the unit material can be stably wound on the winding tube.

In order to achieve the objects of the present invention, there is provided a friction shaft for a slitter that has winding tubes disposed on an outer surface thereof to roll unit materials formed by cutting a raw material such as various kinds of paper, fabric, or film with predetermined intervals.

The friction shaft includes a first rotary shaft rotated by a driving motor and supplied with compressed air from an air supplier.

In the first rotary shaft, a moving passage elongated in a longitudinal direction of the first rotary shaft is formed in the first rotary shaft, first and second supply holes for receiving the compressed air are formed at a side of the outer surface to be connected with the moving passage, first discharge holes are elongated at an opposite side of the outer surface in the longitudinal direction of the first rotary shaft to be connected with the moving passage and are arranged with predetermined intervals in a circumferential direction of the moving passage, second discharge holes are elongated at the opposite side of the outer surface in the longitudinal direction of the first rotary shaft and are arranged with predetermined intervals along a circumference of the first rotary shaft between the first discharge holes, locking steps protrude from open ends of the second discharge holes, connection holes connecting the moving passage and the second discharge holes are formed therein, fitting holes are formed on outer surfaces around the first discharge holes with predetermined intervals in the longitudinal direction of the first rotary shaft, and first fastening holes are formed in the fitting holes.

The friction shaft includes tubes disposed in the second discharge holes and having supply holes connected with the connection holes.

The friction shaft includes lug bodies for torque that are disposed adjacent to each other in a longitudinal direction of the second discharge holes, have installation holes longitudinally formed therein, have insertion holes connected with the installation holes and formed on an outer surface with predetermined intervals in a longitudinal direction thereof, have locking portions protruding outward from both sides of the installation holes to be locked to the locking steps, and have a guide hole elongated in the longitudinal direction on the outer surface to be connected with the insertion holes.

The friction shaft includes first fixed shafts disposed in the installation holes.

The friction shaft includes a plurality of lug rollers for torque that are inserted in the insertion holes to be rotated around the first fixed shafts by first bearings.

The friction shaft includes brake pads inserted in the guide holes between the tubes and the lug bodies for torque and having friction portions protruding from outer surfaces thereof with predetermined intervals in a longitudinal direction to be in close contact with the lug rollers for torque.

The friction shaft includes a second rotary shaft disposed to be movable through the moving passage.

In the second rotary shaft, moving grooves for sending compressed air supplied from the second supply hole to the connection holes are formed in a circular shape and elongated on a side of an outer surface in a longitudinal direction of the second rotary shaft, and second fastening holes are formed with predetermined intervals on an opposite side of the outer surface to face the first discharge holes and are formed with predetermined intervals around the second rotary shaft to face the first discharge holes.

The friction shaft includes guide members having third fastening holes formed on outer surfaces thereof to be fitted to the second fastening holes through fasteners, and having first inclined surfaces formed on outer surfaces facing the first discharge holes.

The friction shaft includes lug bodies for clamping that are disposed adjacent to each other in a longitudinal direction of the first discharge holes, have second inclined surfaces formed on a side of an outer surface to be guided by the first inclined surfaces, have insertion holes formed on an opposite side of the outer surface, have installation holes formed at both sides of the insertion hole, and have locking portions protruding at both sides of the outer surface adjacent to the second inclined surfaces and the insertion holes.

The friction shaft includes second fixed shafts disposed in the installation holes.

The friction shaft includes a plurality of lug rollers for clamping that are inserted in the insertion holes to be rotated around the second fixed shafts by second bearings.

The friction shaft includes covers fitted in the fitting holes, having fourth fastening holes formed on outer surfaces to be fitted to the first fastening holes through the fasteners, and locking the locking portions.

The friction shaft includes a first elastic member disposed between the moving passage and the second rotary shaft to return the second rotary shaft that has been moved.

The friction shaft includes second elastic members disposed between the locking portions and the covers to return the lug bodies for clamping that have been moved.

When compressed air is supplied to the moving passage through the first supply hole, the second rotary shaft is moved through the moving passage by pressure of the compressed air, the lug bodies for clamping are moved while the second inclined surfaces are guided by the first inclined surfaces, the lug rollers for clamping are discharged out of the first discharge holes, the discharged lug rollers for clamping come in close contact with inner surfaces of the winding tubes, and the second supply hole, the moving grooves, and the connection holes are connected by the moved second rotary shaft.

When the compressed air is supplied to the supply holes of the tubes sequentially through the second supply hole, the moving holes, and the connection holes, the tubes are expanded by pressure of the compressed air, the lug bodies for torque and the brake pads are moved, the lug rollers for torque are discharged out of the second discharge holes, and the discharged lug rollers for torque come in close contact with the friction portions and the inner surfaces of the winding tubes.

The present invention, unlike the related art, has the effect of winding unit materials with winding tension of winding tubes that is decreased or increased, depending on pressure of compressed air that is supplied.

That is, unlike the related art, it is possible to wind unit materials in accordance with the thickness and weight of the unit materials.

Further, unlike the related art, it is possible to provide appropriate pressure to lug rollers for torque and lug rollers for clamping on winding tubes such as paper tubes that are easily damaged.

Further, when winding tension of winding tubes that wind unit materials becomes larger than torque of first and second rotary shafts, the winding tubes can slip in the rotational direction of the first and second rotary shaft.

That is, a winding tube can have the same winding tension as other winding tubes around it by slipping, so it is possible to prevent deterioration of product quality in that some unit materials are loosely wound and some unit materials are tightly wound due to different winding tension of the winding tube.

In other words, product quality is improved by normally rolling a plurality of unit material around a plurality of winding tubes with constant winding tension.

Further, it is possible to control rotation of winding tubes using friction between lug rollers for torque and friction portions of brake pads.

That is, it is possible to adjust the winding tension of winding tubes in accordance with the thickness and weight of unit materials.

Further, according to the present invention, unlike the related art, since there is no need for installing several friction cores, the outer diameter of the first rotary shaft corresponding to the main shaft of the related art can be increased larger than the related art, so it is possible to prevent the first rotary shaft from excessively shaking in winding.

That is, displacement of the first rotary shaft in winding is considerably reduced, so the present invention is advantageous in high-load and high-speed working.

Further, unlike the related art, since there is no need for installing several friction cores, the cost for manufacturing the friction shaft for a slitter is reduced.

Further, according to the present invention, even if tubes excessively expand, locking portions of brake pads are locked to locking steps of lug bodies for torque, so the brake pads are not moved up.

That is, it is possible to prevent damage to the lug rollers for torque due to strong pressing of the lug rollers for torque by the friction portions of the brake pads.

Further, according to the present invention, it is possible to prevent slip of winding tubes due to lack of friction of lug rollers for clamping and lug rollers for torque by rubbing urethane and O-ring that have high friction on the inner surfaces of winding tubes.

Further, according to the present invention, since guide members are fitted in fitting holes, locking areas are increased.

That is, rotational response speed of the first and second rotary shafts is increased.

Further, according to the present invention, since the first and second elastic member are springs having high elasticity, the second rotary shaft and the lug bodies for clamping can be more quickly returned.

Further, according to the present invention, when a locking portion of the second rotary shaft are locked to an end of a moving passage, the lug bodies for clamping are not excessively moved up.

That is, it is possible to prevent the lug rollers for clamping from damaging the inner surfaces of the winding tubes by excessively pressing the inner surfaces.

Further, according to the present invention, since the second elastic members are fitted in fitting grooves and fitting holes, it is possible to prevent the second elastic members from separating out of their positions due to elasticity.

Further, according to the present invention, since the tubes are quickly expanded by nozzles that guide compressed air, it is possible to quickly prepare for winding.

Further, according to the present invention, since both open sides of the tubes are sealed by sealing members to prevent leakage of compressed air, friction between the lug rollers for torque and the friction portion of the brake pads can be maintained at a predetermined level.

Further, according to the present invention, since protective films prevent damage to the tubes even if the sealing members strongly press the tubes, it is possible to prevent leakage of compressed air through damaged tubes.

Further, according to the present invention, the winding tubes are not positioned between the lug rollers for torque regardless of the lengths and the installation positions of the winding tubes.

That is, all of a plurality of winding tubes winds unit materials with constant winding tension.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1A:
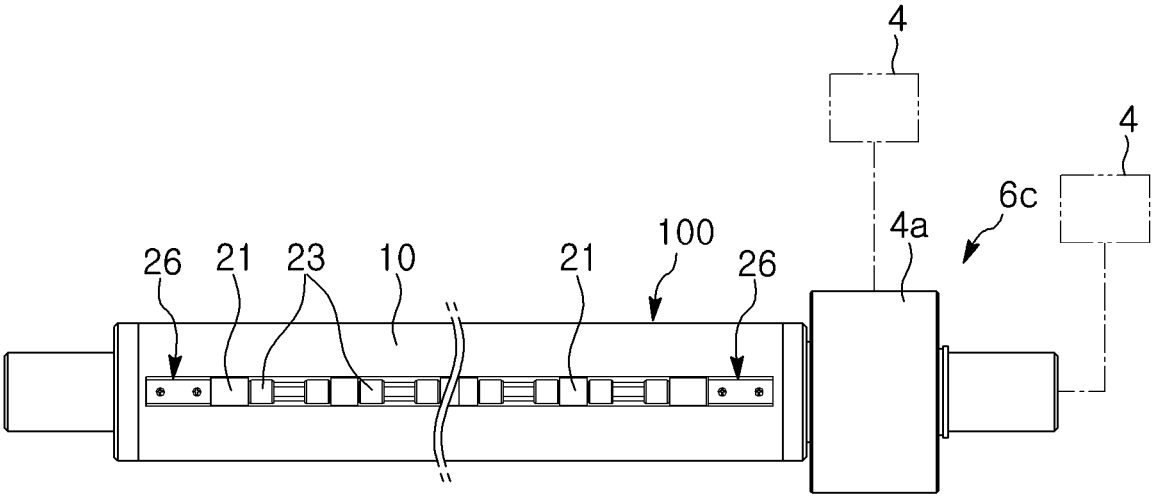
FIGS. 1A to 2 are views showing an installation state of a friction shaft for a slitter according to an embodiment of the present invention.
Figure 1B:
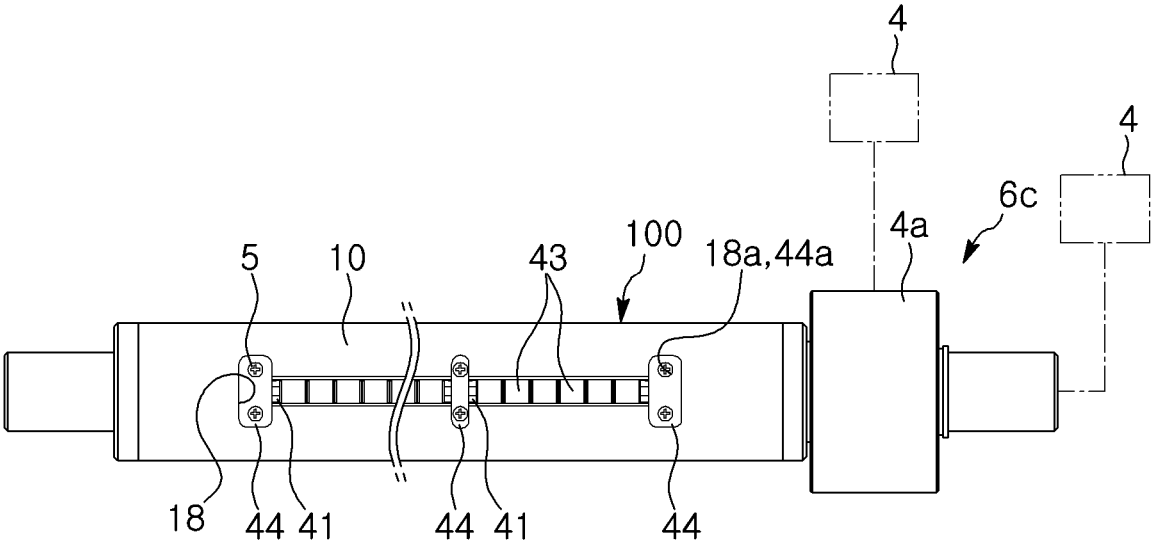
Figure 2:
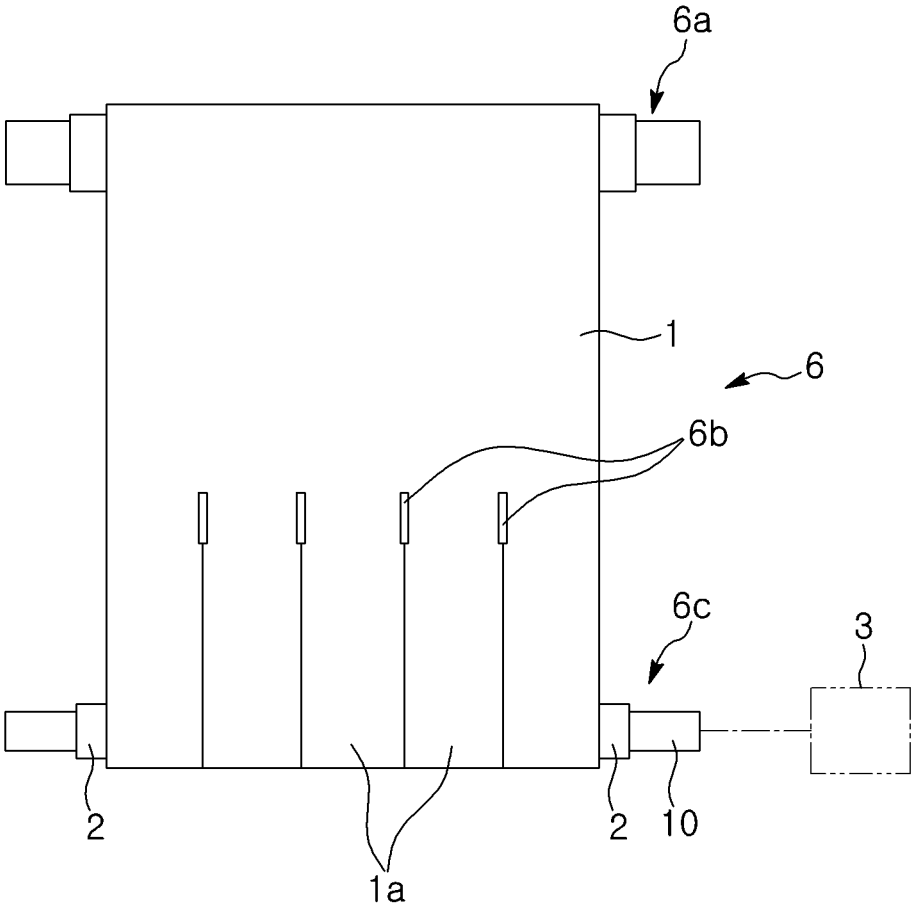
Figure 3:
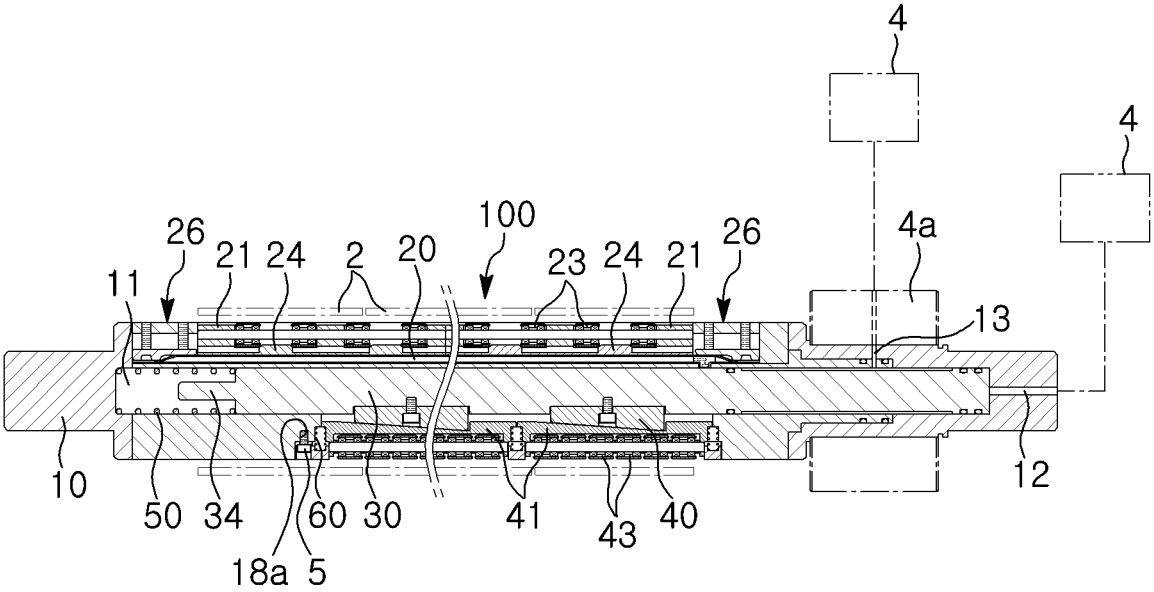
FIG. 3 is a cross-sectional view of the friction shaft for a slitter according to an embodiment of the present invention.
Figure 4A:
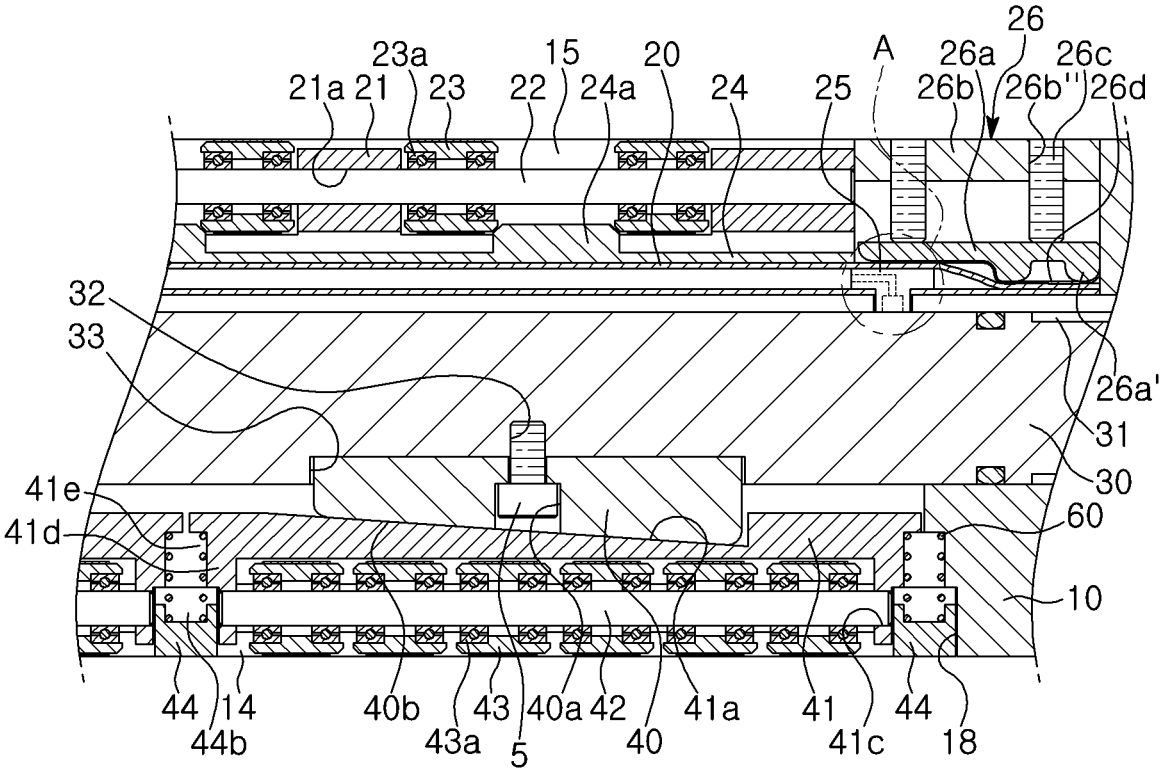
FIGS. 4A to 10C are partial enlarged cross-sectional views and detailed views of FIG. 3.
Figure 4B:
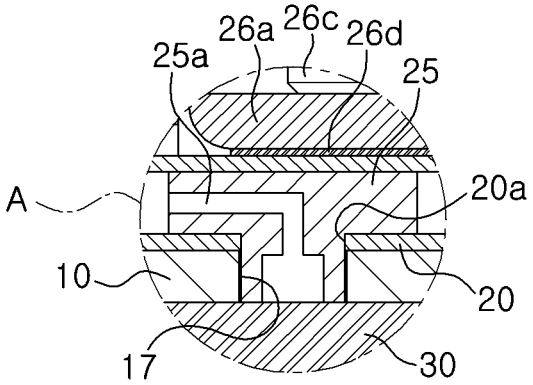
Figure 5:
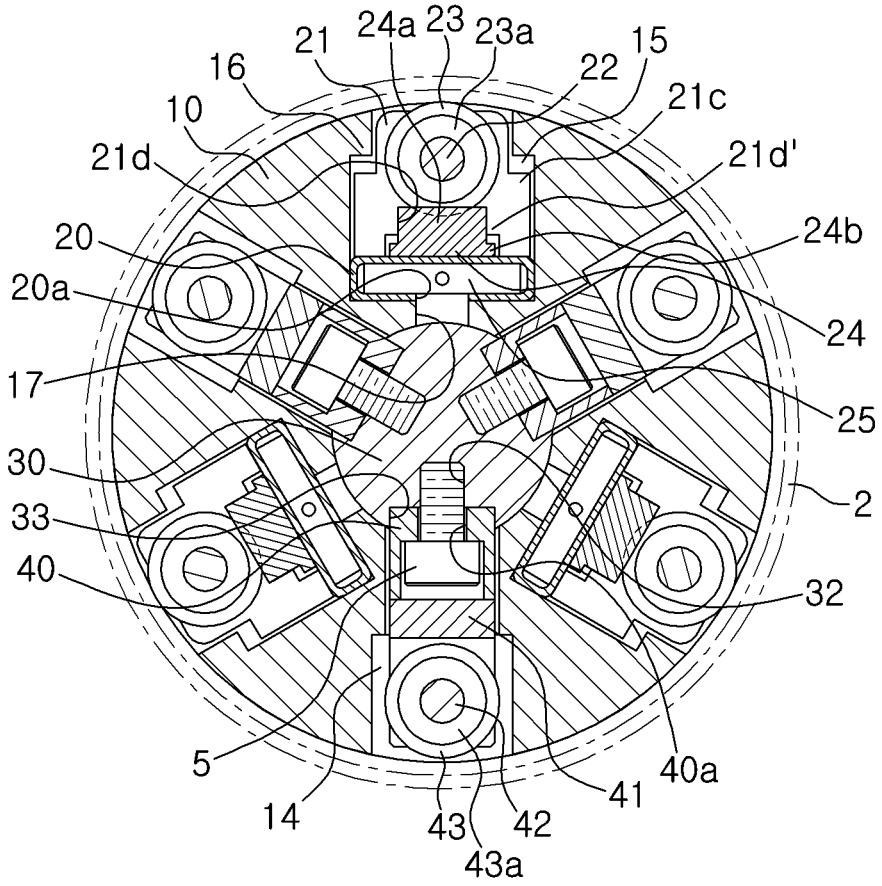
Figure 6A:
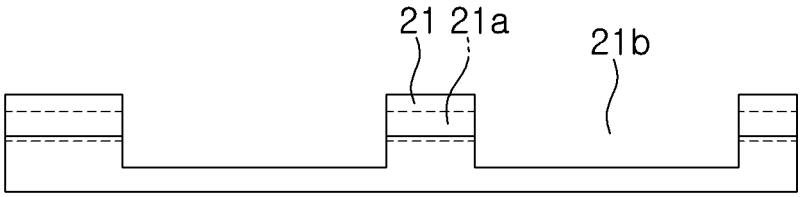
Figure 6B:
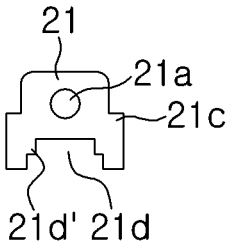
Figure 6C:
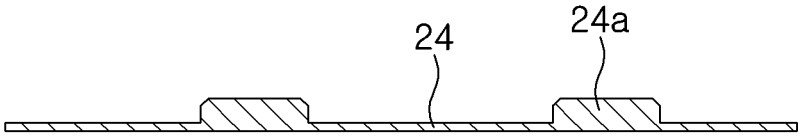
Figure 6D:
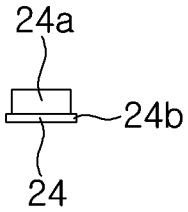
Figure 6E:
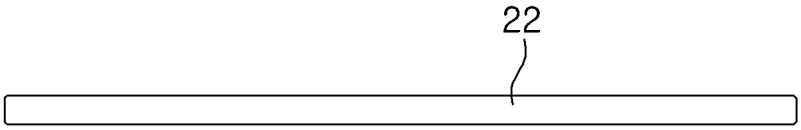
Figure 7A:
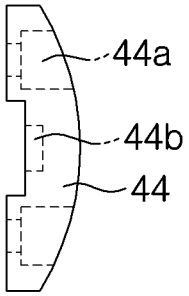
Figure 7B:
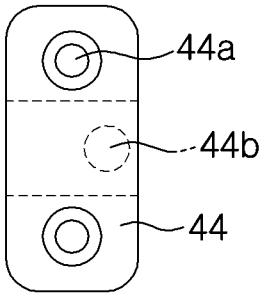
Figure 7C:
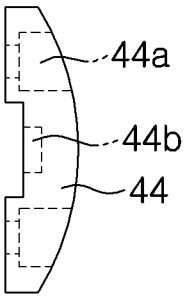
Figure 7D:
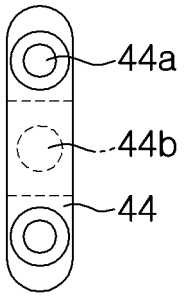
Figure 7E:
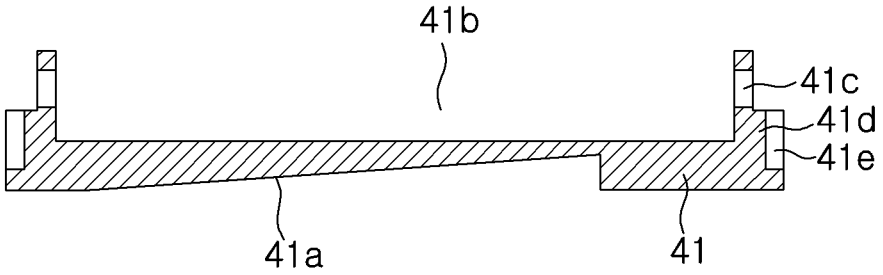
Figure 7F:
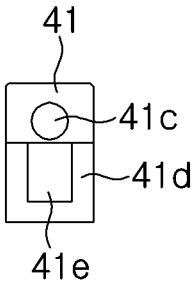
Figure 7G:
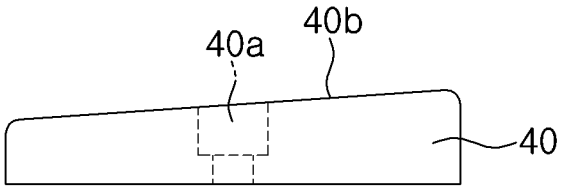
Figure 7H:
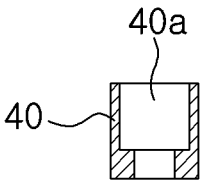
Figure 7I:
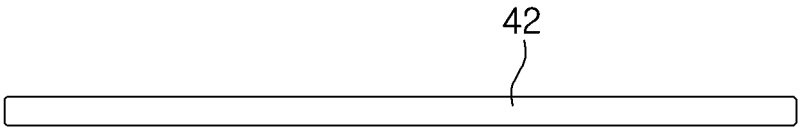
Figure 8A:
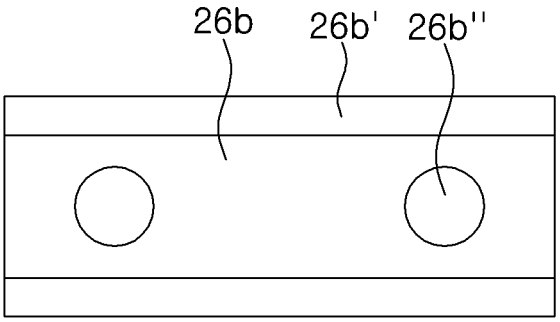
Figure 8B:
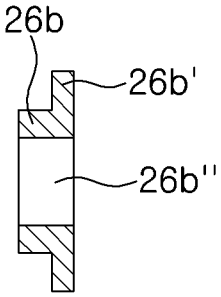
Figure 8C:
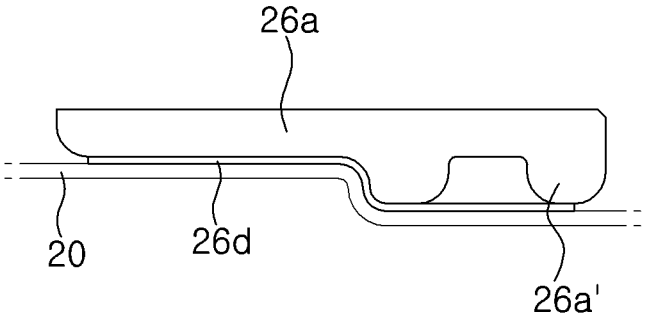
Figure 9A:
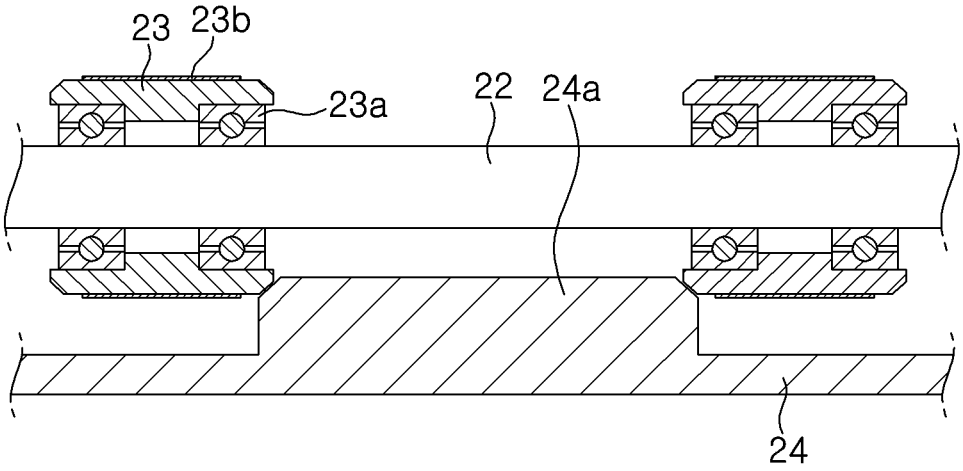
Figure 9B:
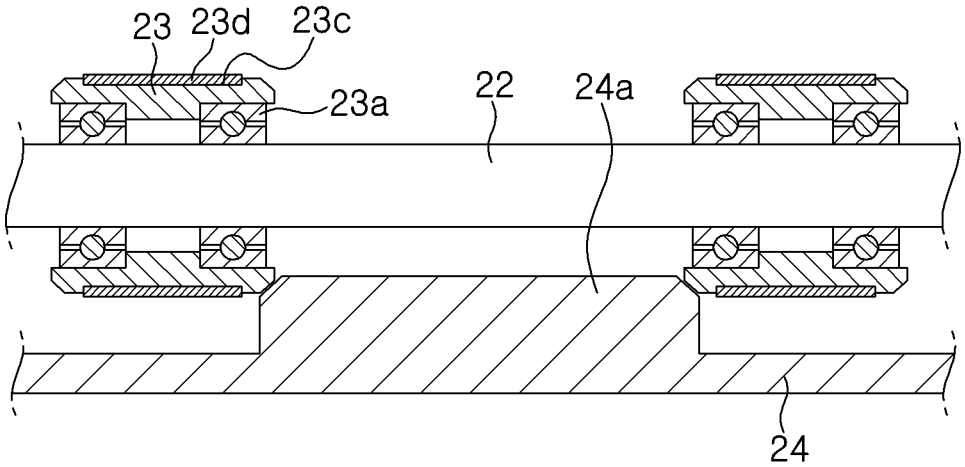
Figure 9C:
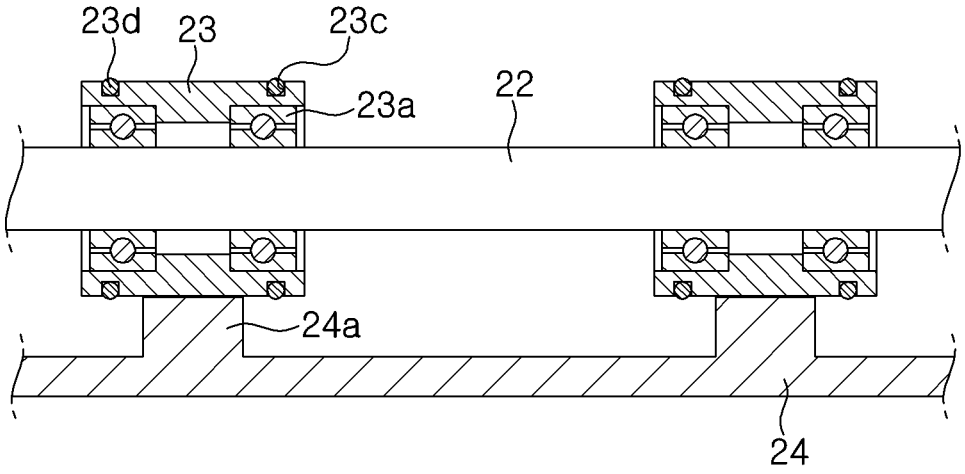
Figure 10A:
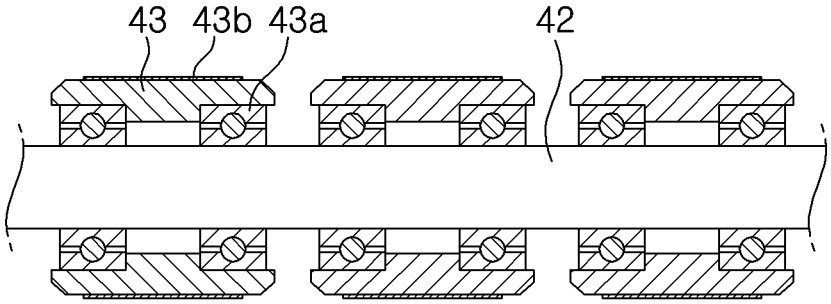
Figure 10B:
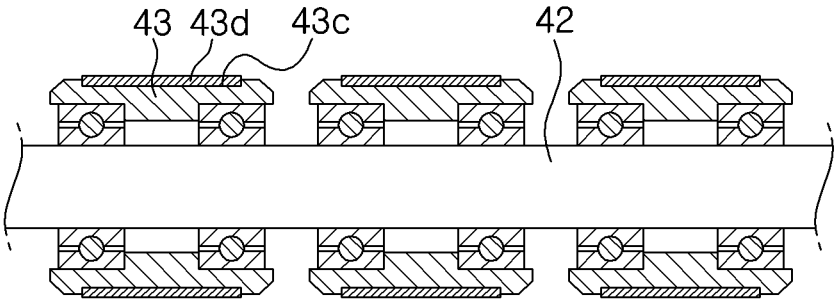
Figure 10C:
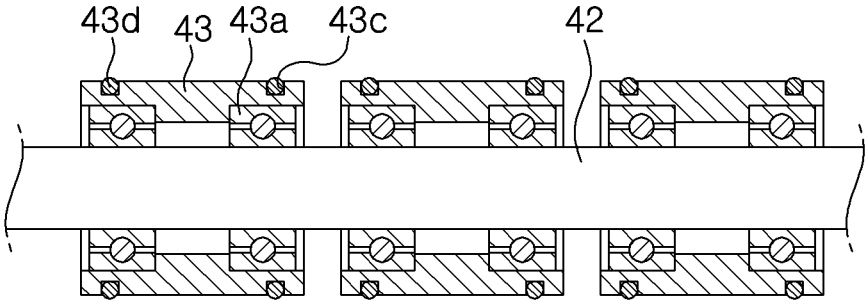
Figure 11A:
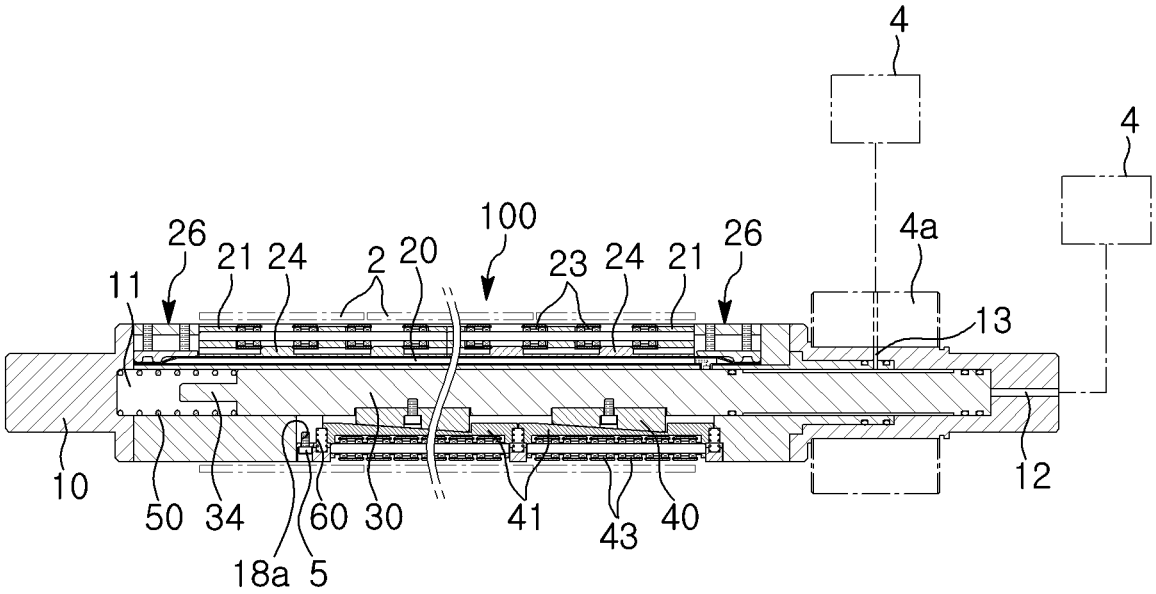
FIGS. 11A to 14B are views showing a use state of the friction shaft for a slitter according to an embodiment of the present invention.
Figure 11B:
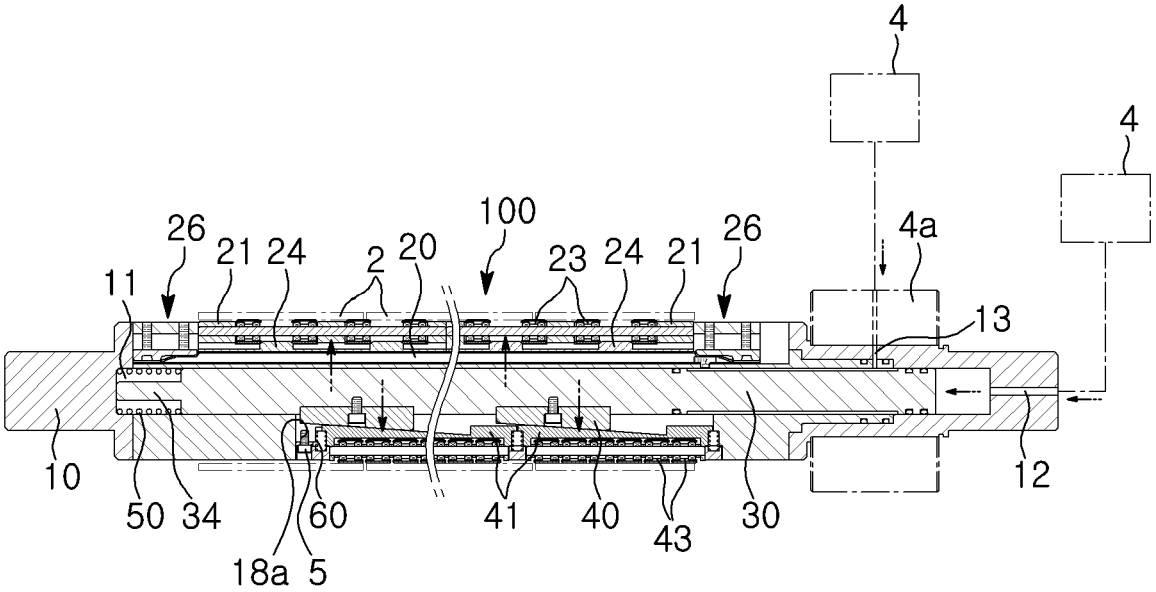
Figure 12A:
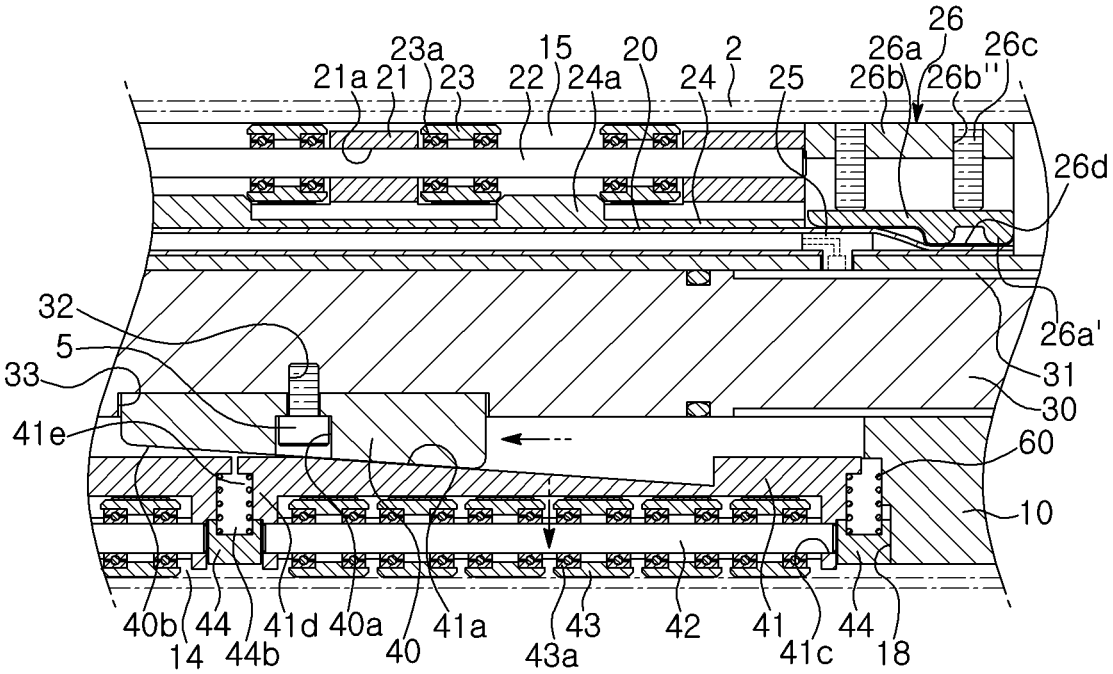
Figure 12B:
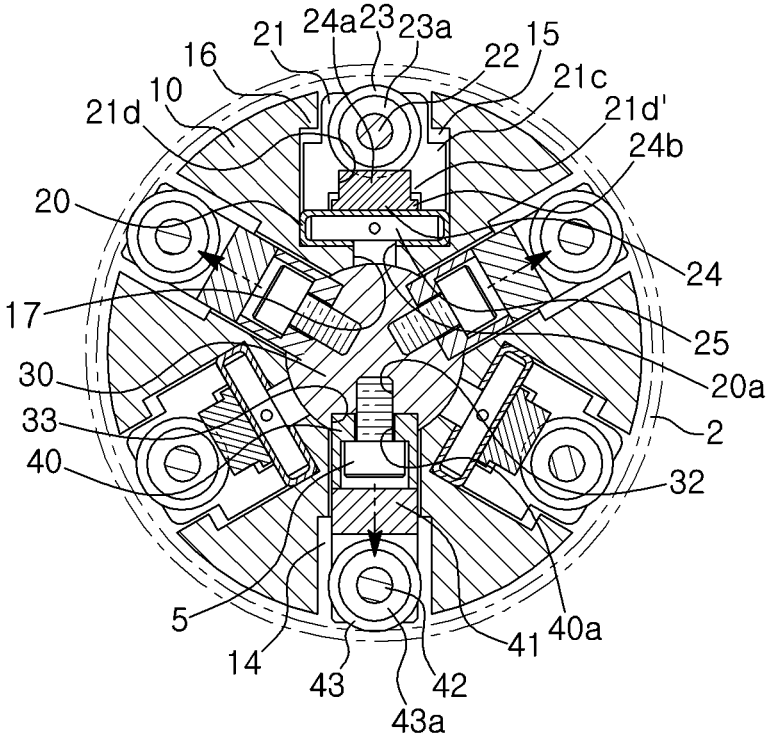
Figure 13A:
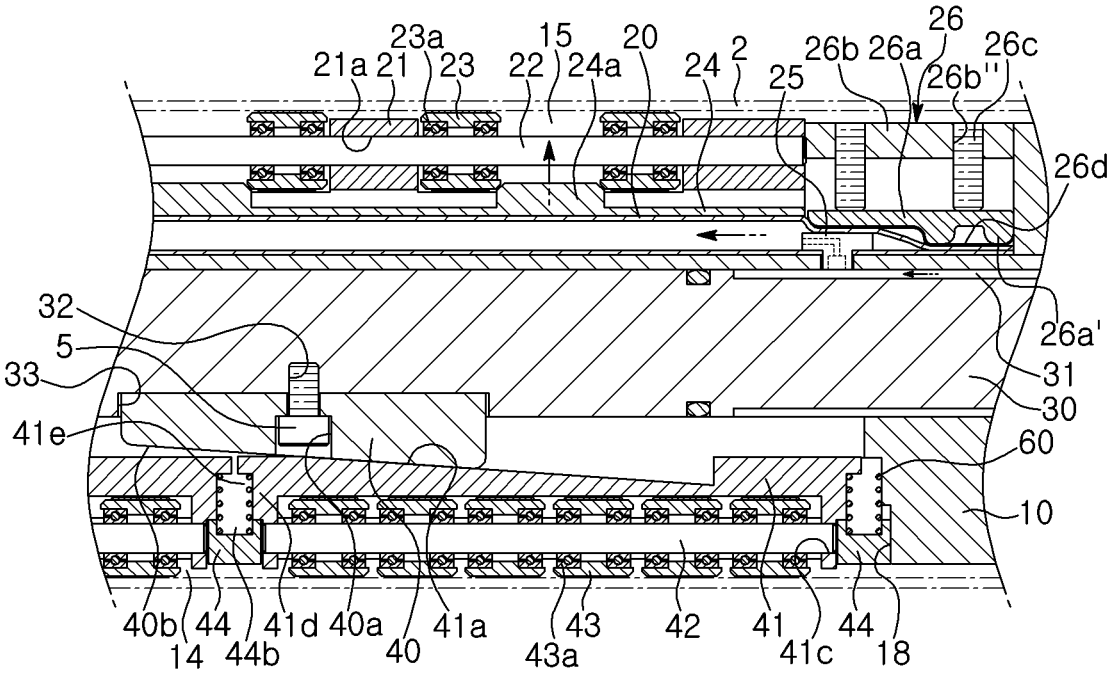
Figure 13B:
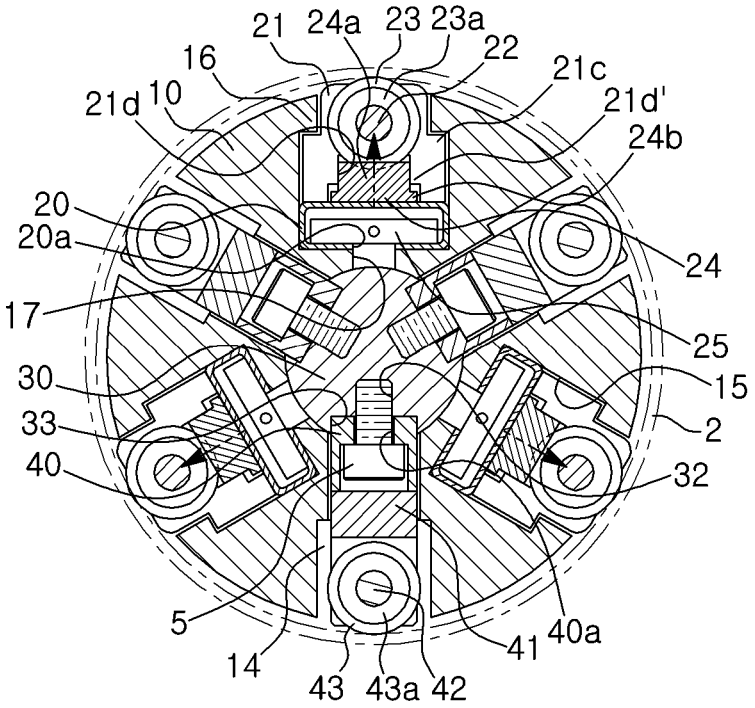
Figure 14A:
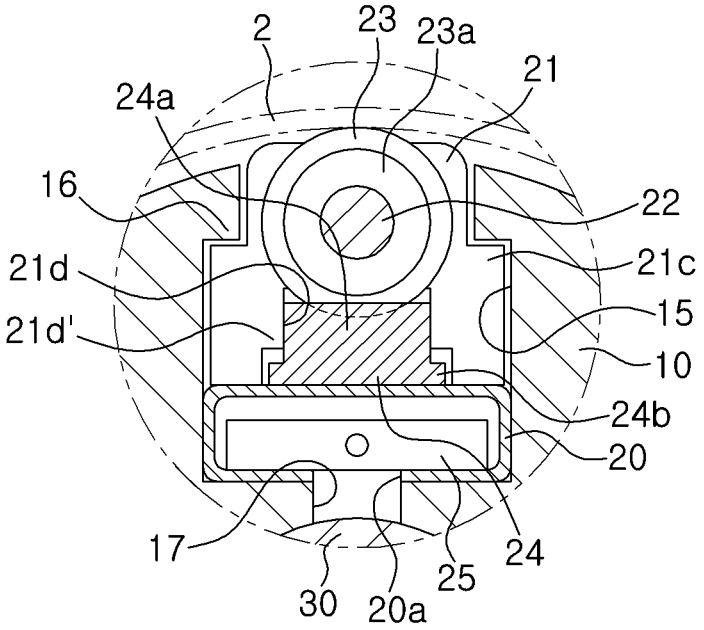
Figure 14B:
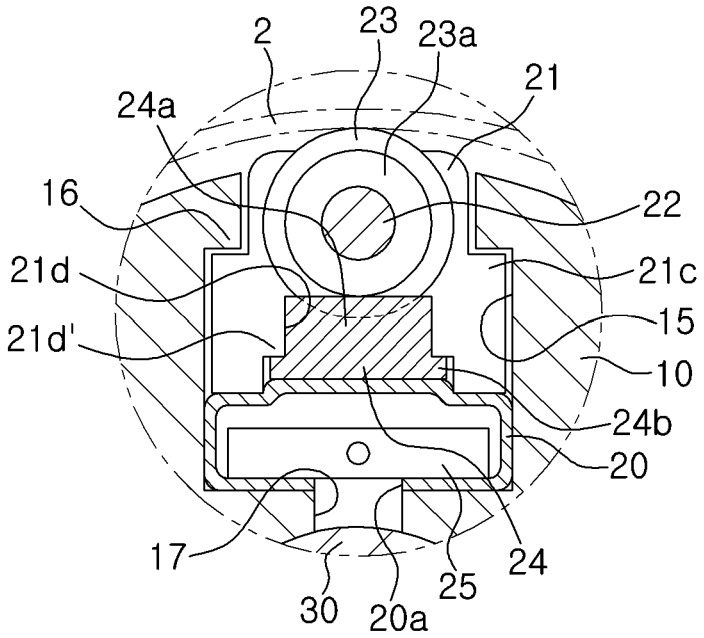

Hereinafter, configurations of exemplary embodiments of the present invention will be described with reference to the accompanying drawings.

As shown in FIGS. 1A to 15, a friction shaft 100 for a slitter according to an embodiment of the present invention is installed on a slitter 6 that includes: a feeder 6*a* that supplies a rolled raw material 1 such as various kinds of paper, fabric, or film; cutters 6*b* that cut the raw material 1 with predetermined intervals; and a winder 6*c* that rolls unit materials 1*a* cut with predetermined intervals from the raw material 1.

That is, the friction shaft 100 for a slitter is installed on the winder 6*c* of the slitter 6.

The winder 6*c* includes a driving motor 3 that rotates the friction shaft 100 for a slitter, an air supplier 4 that supplies compressed air to the friction shaft 100 for a slitter such as an air compressor, and an air transmitter 4*a* that separately supplies compressed air of another air supplier 4 to the friction shaft 100 for a slitter.

The friction shaft 100 for a slitter has winding tubes 2 disposed on the outer surface thereof to roll the unit materials 1*a* formed by cutting the raw material 1 such as various kinds of paper, fabric, or film with predetermined intervals.

In this embodiment, several unit materials 1*a* are formed and several winding tubes 2 corresponding to the unit materials are also disposed on the outer surface of the friction shaft 100 for a slitter.

The winding tubes 2 are paper tubes or FRP cores.

The friction shaft 100 for a slitter includes a first rotary shaft 10 that is rotated by the driving motor 3 and is supplied with compressed air from the air supplier 4.

In the first rotary shaft 10, a moving passage 11 elongated in the longitudinal direction of the first rotary shaft 10 is formed in the first rotary shaft 10, first and second supply holes 12 and 13 for receiving the compressed air are formed at a side of the outer surface to be connected with the moving passage 11, first discharge holes 14 are elongated at the opposite side of the outer surface in the longitudinal direction of the first rotary shaft 10 to be connected with the moving passage 11 and are arranged with predetermined intervals in the circumferential direction of the moving passage 11, second discharge holes 15 are elongated at the opposite side of the outer surface in the longitudinal direction of the first rotary shaft 10 and are arranged with predetermined intervals along the circumference of the first rotary shaft between the first discharge holes 14, locking steps 16 protrude from open ends of the second discharge holes 15, connection holes 17 connecting the moving passage 11 and the second discharge holes 15 are formed therein, fitting holes 18 are formed on outer surfaces around the first discharge holes 14 with predetermined intervals in the longitudinal direction of the first rotary shaft 10, and first fastening holes 18*a* are formed in the fitting holes 18.

The first rotary shaft 10 is formed by combining a plurality of tubes.

The friction shaft 100 for a slitter includes tubes 20 disposed in the second discharge holes 15 and having a supply hole 20*a* connected with the connection hole 17.

The friction shaft 100 for a slitter includes lug bodies 21 for torque that are disposed adjacent to each other in the longitudinal direction of the second discharge holes 15, have installation holes 21*a* longitudinally formed therein, have insertion holes 21*b* connected with the installation holes 21*a* and formed on the outer surface with predetermined intervals in the longitudinal direction, have locking portions 21*c* protruding outward from both sides of the installation holes 21*a* to be locked to the locking steps 16, and have a guide hole 21*d* elongated in the longitudinal direction on the outer surface to be connected with the insertion holes 21*b*.

The friction shaft 100 for a slitter includes first fixed shafts 22 disposed in the installation holes 21*a*.

The friction shaft 100 for a slitter includes a plurality of lug rollers 23 for torque that is inserted in the insertion holes 21*b* to be rotated around the first fixed shafts 22 by first bearings 23*a*.

The first bearings 23*a* may be ball bearings.

Figure 15:
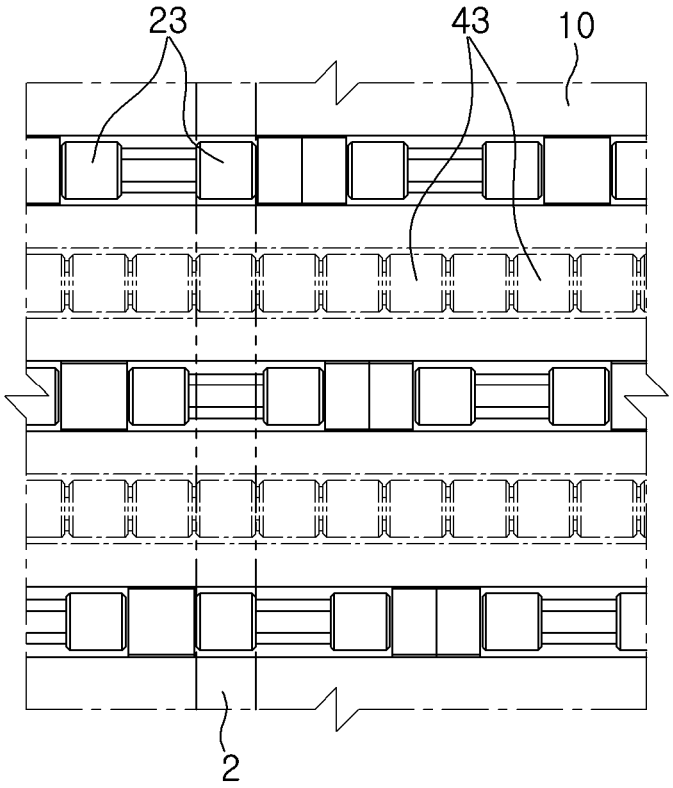
FIG. 15 is a view showing arrangement of lug rollers for torque according to an embodiment of the present invention.

Further, as shown in FIG. 15, the lug rollers 23 for torque are arranged such that the winding tubes 2 are not positioned between the lug rollers 23 for torque.

The lug rollers 23 for torque are arranged such that the positions of the lug bodies 21*a* for torque disposed in the second discharge holes 15 are adjusted in the longitudinal direction of the second discharge holes 15, or the lug rollers 23 for torque are disposed on the first fixed shafts 22.

The friction shaft 100 for a slitter includes brake pads 24 inserted in the guide holes 21*d* between the tubes 20 and the lug bodies 21 for torque and having friction portions 24*a* protruding from the outer surfaces thereof with predetermined intervals in the longitudinal direction to be in close contact with the lug rollers 23 for torque.

The brake pads 24 are formed in a similar shape to a plate shape.

The friction shaft 100 for a slitter includes a second rotary shaft 30 disposed to be movable through the moving passage 11.

In the second rotary shaft 30, moving grooves 31 for sending compressed air supplied from the second supply holes 13 to the connection holes 17 are formed in a circular shape and elongated on a side of the outer surface in the longitudinal direction of the second rotary shaft 30 and second fastening holes 32 are formed with predetermined intervals on an opposite side of the outer surface to face the first discharge holes 14 and are formed with predetermined intervals around the second rotary shaft 30 to face the first discharge holes 14.

The friction shaft 100 for a slitter includes guide members 40 having third fastening holes 40*a* formed on the outer surfaces to be fitted to the second fastening holes 32 through fasteners 5 and having first inclined surfaces 40*b* formed on outer surfaces facing the first discharge holes 14.

The guide members 40 are formed similar to a trapezoidal shape.

The friction shaft 100 for a slitter includes lug bodies 41 for clamping that are disposed adjacent to each other in the longitudinal direction of the first discharge holes 14, have second inclined surfaces 41*a* formed on a side of the outer surface to be guided by the first inclined surfaces 40*b*, have insertion holes 41*b* formed on an opposite side of the outer surface, have installation holes 41*c* formed at both sides of the insertion holes 41*b*, and have locking portions 41*d* protruding at both sides of the outer surface adjacent to the second inclined surfaces 41*a* and the insertion holes 41*b*.

The friction shaft 100 for a slitter includes second fixed shafts 42 disposed in the installation holes 41*c*.

The friction shaft 100 for a slitter includes a plurality of lug rollers 43 for torque that is inserted in the insertion holes 41*b* to be rotated around the second fixed shafts 42 by second bearings 43*a*.

The second bearings 43*a* may be ball bearings.

The friction shaft 100 for a slitter includes covers 44 fitted in the fitting holes 18, having fourth fastening holes 44*a* formed on the outer surfaces to be fitted to the first fastening holes 18*a* through the fasteners 5, and locking the locking portions 41*d*.

The covers 44 are formed not to protrude from the outer surface of the first rotary shaft 10.

The friction shaft 100 for a slitter includes a first elastic member 50 disposed between the moving passage 11 and the second rotary shaft 30 to return the second rotary shaft 30 that has been moved.

The friction shaft 100 for a slitter includes second elastic members 60 disposed between the locking portions 41*d* and the covers 44 to return the lug bodies 41 for clamping that have been moved.

Locking steps 21*d*' are formed in the guide holes 21*d*.

The brake pads 24 have locking portions 24*b* protruding from both sides of the outer surfaces to be locked to the locking steps 21*d*'.

In the lug rollers 23 for torque, the portions that are not in contact with the friction portions 24*a* are coated with urethane 23*b* having high friction.

Further, in the lug rollers 23 for torque, fitting grooves 23*c* may be formed on the portions that are not in contact with the friction portions 24*a* instead of the urethane 23*b*, and the friction shaft 100 for a slitter may include O-rings 23*d* having high friction and fitted in the fitting grooves 23*c*.

The fitting grooves 23*c* and the O-rings 23*d* may be formed similar to a ring shape or a plate shape and the friction portions 24*a* may also be formed in a shape not to come in close contact with the O-rings 23*d*.

The lug rollers 43 for clamping are coated with urethane 43*b* having high friction.

Further, in the lug rollers 43 for torque, fitting grooves 43*c* may be formed instead of the urethane 43*b*, and the friction shaft 100 for a slitter may include O-rings 43*d* having high friction and fitted in the fitting grooves 43*c*.

The fitting grooves 43*c* and the O-rings 43*d* may be formed similar to a ring shape or a plate shape.

Fitting holes 33 in which the guide members 40 are fitted are formed around the second fastening holes 32 on the outer surface of the second rotary shaft 30.

The first and second elastic members 50 and 60 are springs having high elasticity.

A protrusive locking portion 34 inserted in the first elastic member 50 that is a spring is formed on the second rotary shaft 30.

That is, the protrusive locking portion 34 is formed on the second rotary shaft 30 to be immediately locked in the moving passage when the second rotary shaft 30 is moved by pressure of the compressed air and the lug rollers 43 for clamping are discharged from the first discharge holes 14.

Fitting grooves 41*e* in which the second elastic members 60 are fitted are formed at the locking portions 41*d* of the lug bodies 41 for clamping and fitting holes 44*b* in which the second elastic members 60 are fitted are formed at the covers 44.

The elastic members 60 that are springs are fitted in the fitting grooves 41*e* and the fitting holes 44*b*.

The friction shaft 100 for a slitter includes nozzles 25 each having a side inserted in the tube 20 and the other side fitted in the supply hole 20*a* and the connection hole 17.

The nozzles 25 have an L-shaped guide space 25*a* so that the supplied compressed air quickly moves in the longitudinal direction of the tubes 20.

In the friction shaft 100 for a slitter, the entire lengths of the lug bodies 21 for torque are smaller than the lengths of the tubes 20 and sealing members 26 that are disposed in the discharge holes 15 at both sides of the lug bodies 21 for torque and press and seal both open sides of the tubes 20 are included.

The sealing members 26 each include a first moving plate 26*a* disposed in the second discharge hole 15 in close contact with the tube 20.

The sealing members 26 each include a second moving plate 26*b* disposed in the second discharge hole 15, having locking portions 26*b*' protruding from both sides of the outer surface to be locked to the locking steps 16, and having fifth fastening holes 26*b*" formed at the center portion with predetermined intervals in the longitudinal direction.

The sealing members 26 each include set screws 26*c* fastened in the fifth fastening holes 26*b*".

That is, when the set screws 26*c* are fastened in the fifth fastening holes 26*b*" of the sealing member 26 and press the first moving plate 26*a*, the first moving plate 26*a* is moved by the pressure from the set screws 26*c*, thereby pressing and sealing one open side of the tube 20. Further, as the set screws 26*c* are fastened in the fifth fastening holes 26*b*", the second moving plate 26*b* is moved, whereby the locking portions 26*b*' are locked to the locking steps 16.

The first moving plate 26*a* has protrusive pressing portions 26*a*' formed in L-shapes on a side of the outer surface to press the one open side of the tube 20

That is, when the set screws 26*c* are fastened in the fifth fastening holes 26*b*", the pressing portions 26*a*' of the first moving plate 26*a* press and seal the one open side of the tube 20 and the opposite side of the outer surface of the first moving plate 26*a* presses and brings the tube 20 in close contact with the nozzle 25.

A protective film 26*d* that protects the tube 20 from damage is attached to the first moving plate 26*a*.

The friction shaft 100 for a slitter includes sealing members such as sealing rings that prevent compressed air to be supplied to the first and second supply holes 12 and 13 from moving to another place or leaking outside.

The friction shaft 100 for a slitter includes spacers that are disposed between the lug rollers 23 for torque or the lug rollers 43 for clamping to maintain the gaps.

The friction shaft 100 for a slitter may use a screw type or a cylinder instead of compressed air in order to move the second rotary shaft 30 though the moving passage 11.

The operation and effect of the present invention having the configuration described above are as follows.

As shown in FIGS. 1A to 15, according to the friction shaft 100 for a slitter of an embodiment of the present invention, the winding tubes 2 are fitted on the first rotary shaft 10 to be able to roll a plurality of unit materials 1*a* on them, respectively, in which the unit materials 1*a* are formed by cutting a raw material 1 such as various kinds of paper, fabric, or film with predetermined intervals.

The friction shaft 100 for a slitter is supplied with compressed air through the air transmitter 4*a* and the air supplier 4 with the winding tubes 2 fitted.

The air supplier 4 supplies appropriate compressed air to decrease the winding tension of the winding tubes 2 when the unit materials 1*a* of the raw material 1 are thin and light, and supplies appropriate compressed air to increase the winding tension of the winding tubes 2 when the unit materials 1*a* of the raw material 1 are thick and heavy.

That is, the friction shaft 100 for a slitter is supplied with compressed air to obtain torque corresponding to the winding tension of the winding tubes 2.

In other words, the friction shaft 100 for a slitter is supplied with compressed air, which can correspond to the thickness and weight of the unit materials 1*a*, from the air supplier 4.

Accordingly, when the compressed air supplied from the air supplier 4 is supplied to the first supply hole 12 of the first rotary shaft 10, the second rotary shaft 30 is moved through the moving passage 11 by the pressure of the compressed air.

Accordingly, the second inclined surfaces 41*a* of the lug bodies 41 for clamping are guided by the first inclined surfaces 40*b* of the guide members 40 and the lug bodies 41 for clamping are moved up, so the lug rollers 43 for clamping are discharged out of the first discharge holes 14 and the discharged lug rollers 43 for clamping come in close contact with the inner surface of the winding tubes 2.

Since the guide members 40 are fitted in the fitting holes 33 of the second rotary shaft 30, the first inclined surfaces 40*b* of the guide members 40 more accurately guide the second inclined surfaces 41*a* of the lug bodies 41 for clamping without shaking.

Meanwhile, the second rotary shaft 30 is no longer moved due to the elasticity of the first elastic member 50, and the locking portions 34 is blocked to an end of the moving path 11, so the second rotary shaft 30 further cannot be moved.

Since the first elastic member 50 is a spring, it contracts.

Meanwhile, the locking portions 41*d* are locked to the covers 44, so the lug bodies 41 for clamping can be moved no longer and cannot be further moved due to the elasticity of the second elastic members 60.

Since the second elastic members 60 are springs, they contract.

The second supply hole 13, the moving grooves 31, and the connection holes 17 are connected by the moved second rotary shaft 30.

On the other hand, when compressed air of another air supplier 4 is separately supplied to the second supply hole 13 of the first rotary shaft 10 through the air transmitter 4*a*, the compressed air is supplied to the supply holes 20*a* of the tubes 20 after sequentially passing through the second supply hole 13, the moving grooves 31, and the connection holes 17.

The compressed air is guided by the L-shaped guide spaces 25*a* of the nozzles 25, so it quickly moves into the tubes 20 in the longitudinal direction of the tubes 20.

In this process, since the sealing member 26 press and seal both open sides of the tubes 20, the compressed air moving in the tubes 20 cannot flow outside through both open sides of the tubes 20.

In detail, since the set screws 26*c* fastened in the fifth fastening holes 26*b*" press the first moving plates 26*a*, the pressing portions 26*a*' of the first moving plates 26*a* press and seal one open side of each of the tubes 20.

Further, since the opposite side of the outer surfaces of the first moving plates 26*a* where the pressing portions 26*a*' are not formed press and bring the tubes 20 in close contact with the nozzles 25, the one open side of each of the tubes 20 is further sealed.

Since the protective films 26*d* are attached to the first moving plates 26*a*, the tubes 20 are not damaged by the protective films 26 even though the first moving plates 26*a* keep pressing the tubes 20.

The second moving plates 26*b* are moved by fastening the set screws 26*c* in the fifth fastening holes 26*b*" and the locking portions 26*b*' are locked and fixed to the locking steps 16 of the first rotary shaft 10, so one side of each of the tubes 20 is kept sealed.

That is, both open sides of the tubes 20 are sealed by the sealing members 26.

Further, the tubes 20 are expanded by the pressure of the compressed air and the lug bodies 21 for torque and the brake pads 24 are moved up, so the lug rollers 23 for torque are discharged from the second discharge holes 15.

The discharged lug rollers 23 for torque come in close contact with the friction portions 24*a* and the inner surfaces of the winding tubes 2.

The locking portions 21*c* are locked to the locking steps 16 of the first rotary shaft 10, so the lug bodies 21 for torque can move no longer.

Accordingly, the winding tubes 2 are fixed to the lug rollers 23 for toque and the lug rollers 43 for clamping of the friction shaft 100 for a slitter.

Then, the friction shaft 100 for a slitter with the winding tubes 2 fixed is rotated by operating the driving motor 3 of the slitter 6.

The first rotary shaft 10 is rotated by the driving motor 3 and the second rotary shaft 30 is rotated with the guiding members 40 locked in the first discharge holes 14 of the first rotary shaft 10.

Accordingly, the winding tubes 2 are rotated by friction generated on the inner surfaces thereof that are in close contact with the lug rollers 23 for torque and the lug rollers for clamping, thereby winding the unit materials 1*a*, respectively.

That is, the winding tubes 2 wind the unit materials 1*a* with predetermined winding tension.

The lug rollers 23 for torque and the lug rollers 43 for clamping are also rotated on the first and second fixed shafts 22 and 42 by the first and second bearings 23*a* and 43*a*.

If the unit materials 1*a* of the raw material 1 that is supplied from the feeder 6*a* of the slitter 6 are thicker and heavier, the tubes 20 are further expanded by further supplying compressed air to the tubes 20.

Accordingly, portions of the further expanded tubes 20 are inserted into the guide holes 21*d*, thereby pressing the brake pads 24.

The brake pads 24 are guided and moved in the guide holes 21*d*, so the friction portions 24*a* are further brought in close contact with the lug rollers 23 for torque.

That is, the friction between the friction portions 24*a* of the brake pads 24 and the lug rollers 23 for torque is increased.

In other words, the lug rollers 23 for torque, the lug rollers 43 for clamping, and the winding tubes 2 are appropriately rotated to increase the winding tension of the winding tubes 2.

Meanwhile, the locking portions 24*b* of the brake pads 24 are locked to the locking steps 21*d* of the lug bodies 21 for torque', so they can move no longer.

The winding tube 2 that winds a unit material 1*a* corresponding to a width-directional thicker portion of the raw material 1 generates larger winding tension than winding tubes 2 around it.

That is, the winding tension of the winding tube 2 is larger than torque of the first and second rotary shafts 10 and 30 of the friction shaft 100 for a slitter.

Accordingly, slip is generated between the lug roller 23 for torque and the friction portion 24*a* of the brake pad 24, so rotation of the lug roller 23 for torque becomes slower than the first and second rotary shafts 10 and 30.

Further, rotation of the winding tube 2 being in close contact with the lug roller 23 for torque also becomes slow, so rotation of the lug roller 43 for torque being in close contact with the winding tube 2 also becomes slow.

That is, the winding tube 2 winds the unit material 1*a* while rotating slower than the winding tubes 2 around it.

In other words, the winding tension of the winding tube 2 becomes the same as the winding tension of the winding tubes 2 around it.

On the other hand, since the lug rollers 23 for torque and the lug rollers 43 for clamping are coated with the urethane 23*b* and 43*b* or the O-rings 23*d* and 43*d* are fitted in the fitting grooves 23*c* and 43*c*, the friction with the inner surfaces of the winding tubes 2 is large.

That is, the winding tubes 2 are prevented from moving not in the rotational direction, but in the longitudinal direction of the friction shaft 100 for a slitter.

Accordingly, when the unit materials 1*a* are rolled around the winding tubes 2 fixed to the friction shaft 100 for a slitter, supply of compressed air to the friction shaft 100 for a slitter is stopped and the operation of the driving motor 3 is stopped.

Accordingly, the second rotary shaft 30 is returned through the moving passage 11 by the elasticity of the first elastic member 50.

The lug bodies 41 for clamping are returned through the first discharge holes 14 by the elasticity of the second elastic members 60 and the lug rollers 43 for clamping are inserted back into the first discharge holes 14.

Since the second elastic members 60 are fitted in the fitting grooves 41*e* and the fitting holes 44*b*, they cannot be elastically separated out of the fitting grooves 41*e* and the fitting holes 44*b*.

The tubes 20 contract due to reduction of the compressed air, and the lug bodies 21 for torque and the brake pads 24 are returned through the second discharge holes 15.

The lug rollers 23 for torque are inserted back into the second discharge holes 15.

Accordingly, the lug rollers 23 for torque and the lug rollers 43 for clamping are not in close contact with the inner surfaces of the winding tubes 2.

Then, the winding tubes 2 with the unit materials 1*a* wound thereon are pulled out from the outer surface of the friction shaft 100 for a slitter of the present invention, thereby finishing winding.

On the other hand, as shown in FIG. 15, since the lug rollers 23 for torque are disposed such that the winding tubes 2 are not positioned between the lug rollers 23 for torque, the lug rollers 23 for torque are necessarily in close contact with the inner surfaces of the winding tubes 2 regardless of the lengths of the winding tubes 2 and the positions of the winding tubes 2 on the outer surface of the friction shaft 100 for a slitter.

Although the present invention was described above with reference to specific embodiments, the present invention is not limited to the embodiments and may be changed and modified in various ways by those skilled in the art without departing from the scope of the present invention.

What is claimed is:

1. A friction shaft for a slitter that has winding tubes disposed on an outer surface thereof to roll unit materials formed by cutting a raw material such as various kinds of paper, fabric, or film with predetermined intervals, the friction shaft comprising a first rotary shaft rotated by a driving motor and supplied with compressed air from an air supplier, wherein, in the first rotary shaft (10), a moving passage elongated in a longitudinal direction of the first rotary shaft is formed in the first rotary shaft, first and second supply holes for receiving the compressed air are formed at a side of the outer surface to be connected with the moving passage, first discharge holes are elongated at an opposite side of the outer surface in the longitudinal direction of the first rotary shaft to be connected with the moving passage and are arranged with predetermined intervals in a circumferential direction of the moving passage, second discharge holes are elongated at the opposite side of the outer surface in the longitudinal direction of the first rotary shaft and are arranged with predetermined intervals along a circumference of the first rotary shaft between the first discharge holes, locking steps protrude from open ends of the second discharge holes, connection holes connecting the moving passage and the second discharge holes are formed therein, fitting holes are formed on outer surfaces around the first discharge holes with predetermined intervals in the longitudinal direction of the first rotary shaft, and first fastening holes are formed in the fitting holes, the friction shaft includes tubes disposed in the second discharge holes and having supply holes connected with the connection holes, the friction shaft includes lug bodies for torque that are disposed adjacent to each other in a longitudinal direction of the second discharge holes, have installation holes longitudinally formed therein, have insertion holes connected with the installation holes and formed on an outer surface with predetermined intervals in a longitudinal direction thereof, have locking portions protruding outward from both sides of the installation holes to be locked to the locking steps, and have a guide hole elongated in the longitudinal direction on the outer surface to be connected with the insertion holes, the friction shaft includes first fixed shafts disposed in the installation holes, the friction shaft includes a plurality of lug rollers for torque that is inserted in the insertion holes to be rotated around the first fixed shafts by first bearings, the friction shaft includes brake pads inserted in the guide holes (21*d*) between the tubes and the lug bodies for torque and having friction portions protruding from outer surfaces thereof with predetermined intervals in a longitudinal direction to be in close contact with the lug rollers for torque, the friction shaft includes a second rotary shaft disposed to be movable through the moving passage, wherein, in the second rotary shaft, moving grooves for sending compressed air supplied from the second supply hole to the connection holes are formed in a circular shape and elongated on a side of an outer surface in a longitudinal direction of the second rotary shaft, and second fastening holes are formed with predetermined intervals on an opposite side of the outer surface to face the first discharge holes and are formed with predetermined intervals around the second rotary shaft to face the first discharge holes, the friction shaft includes guide members having third fastening holes formed on outer surfaces thereof to be fitted to the second fastening holes through fasteners, and having first inclined surfaces formed on outer surfaces facing the first discharge holes, the friction shaft includes lug bodies for clamping that are disposed adjacent to each other in a longitudinal direction of the first discharge holes, have second inclined surfaces formed on a side of an outer surface to be guided by the first inclined surfaces, have insertion holes formed on an opposite side of the outer surface, have installation holes formed at both sides of the insertion hole, and have locking portions protruding at both sides of the outer surface adjacent to the second inclined surfaces and the insertion holes, the friction shaft includes second fixed shafts disposed in the installation holes, the friction shaft includes a plurality of lug rollers for clamping that is inserted in the insertion holes to be rotated around the second fixed shafts by second bearings, the friction shaft includes covers fitted in the fitting holes, having fourth fastening holes formed on outer surfaces to be fitted to the first fastening holes through the fasteners, and locking the locking portions, the friction shaft includes a first elastic member disposed between the moving passage and the second rotary shaft to return the second rotary shaft that has been moved, the friction shaft includes second elastic members disposed between the locking portions and the covers to return the lug bodies for clamping that have been moved, when compressed air is supplied to the moving passage through the first supply hole, the second rotary shaft is moved through the moving passage by pressure of the compressed air, the lug bodies for clamping are moved while the second inclined surfaces are guided by the first inclined surfaces, the lug rollers for clamping are discharged out of the first discharge holes, the discharged lug rollers for clamping come in close contact with inner surfaces of the winding tubes, and the second supply hole, the moving grooves, and the connection holes are connected by the moved second rotary shaft, and when the compressed air is supplied to the supply holes of the tubes sequentially through the second supply hole, the moving holes, and the connection holes, the tubes are expanded by pressure of the compressed air, the lug bodies for torque and the brake pads are moved, the lug rollers for torque are discharged out of the second discharge holes, and the discharged lug rollers for torque come in close contact with the friction portions and the inner surfaces of the winding tubes.

2. The friction shaft of claim 1, wherein locking steps are formed in the guide holes, and the brake pads have locking portions protruding from both sides of outer surfaces to be locked to the locking steps.

3. The friction shaft of claim 1, wherein, in the lug rollers for torque, portions that are not in contact with the friction portions are coated with urethane.

4. The friction shaft of claim 1, wherein, the lug rollers for torque has fitting grooves formed on portions that are not in contact with the friction portions, and includes O-rings fitted in the fitting grooves.

5. The friction shaft of claim 1, wherein the lug rollers for clamping are coated with urethane.

6. The friction shaft of claim 1, wherein, the lug rollers for clamping has fitting grooves and include O-rings fitted in the fitting grooves.

7. The friction shaft of claim 1, wherein fitting holes in which the guide members are fitted are formed around the second fastening holes on the outer surface of the second rotary shaft.

8. The friction shaft of claim 1, wherein the first and second elastic members are springs.

9. The friction shaft of claim 8, wherein the second rotary shaft has a protrusive locking portion inserted in the first elastic member that is a spring, so when the second rotary shaft is moved by pressure of the compressed air and the lug rollers for clamping are discharged out of the first discharge holes, the locking portion is locked in the moving passage.

10. The friction shaft of claim 1, wherein the locking portions have fitting grooves in which the second elastic members are fitted, and the covers have fitting holes in which the second elastic members are fitted.

11. The friction shaft of claim 1, comprising nozzles having a side inserted in the tube and an opposite side fitted in the supply hole and the connection hole, and the nozzles have an L-shaped guide space so that the supplied compressed air quickly moves in the longitudinal direction of the tubes.

12. The friction shaft of claim 11, wherein the entire lengths of the lug bodies for torque are smaller than lengths of the tubes and sealing members that are disposed in the discharge holes at both sides of the lug bodies for torque and press and seal both open sides of the tubes are included.

13. The friction shaft of claim 12, wherein the sealing members each include:

a first moving plate disposed in the second discharge hole in close contact with the tube;

a second moving plate disposed in the second discharge hole, having locking portions protruding from both sides of the outer surface to be locked to the locking steps, and having fifth fastening holes formed at a center portion with predetermined intervals in the longitudinal direction; and set screws fastened in the fifth fastening holes, and when the set screws are fastened in the fifth fastening holes of the sealing member and press the first moving plate, the first moving plate is moved by pressure from the set screws, thereby pressing and sealing one open side of the tube, and as the set screws are fastened in the fifth fastening holes, the second moving plate is moved, whereby the locking portions are locked to the locking steps.

14. The friction shaft of claim 13, wherein the first moving plate has protrusive pressing portions formed on a side of an outer surface to press the one open side of the tube, and when the set screws are fastened in the fifth fastening holes, the pressing portions of the first moving plate press and seal the one open side of the tube and an opposite side of the outer surface of the first moving plate presses and brings the tube in close contact with the nozzle.

15. The friction shaft of claim 14, wherein a protective film that protects the tube from damage is attached to the first moving plate.

16. The friction shaft of claim 1, wherein the lug rollers for torque are arranged such that the winding tubes are not positioned between the lug rollers for torque.

17. The friction shaft of claim 8, wherein the locking portions have fitting grooves in which the second elastic members are fitted, and the covers have fitting holes in which the second elastic members are fitted.

* * * * *